US010269483B2

(12) United States Patent
Neumueller

(10) Patent No.: US 10,269,483 B2
(45) Date of Patent: Apr. 23, 2019

(54) ELECTRICAL DEVICE WITH DYNAMIC WINDING PRESSING

(71) Applicant: SIEMENS AKTIENGESELLSCHAFT, Munich (DE)

(72) Inventor: Gernot Neumueller, Lichtenberg (AT)

(73) Assignee: Siemens Aktiengesellschaft, Munich (DE)

( * ) Notice: Subject to any disclaimer, the term of this patent is extended or adjusted under 35 U.S.C. 154(b) by 90 days.

(21) Appl. No.: 15/420,325

(22) Filed: Jan. 31, 2017

(65) Prior Publication Data

US 2018/0114630 A1 Apr. 26, 2018

(30) Foreign Application Priority Data

Oct. 26, 2016 (DE) ..... 10 2016 221 114

(51) Int. Cl.

| | |
|---|---|
| ***H01F 27/30*** | (2006.01) |
| ***H01F 27/12*** | (2006.01) |
| ***H01F 27/40*** | (2006.01) |
| *H01F 30/06* | (2006.01) |

(52) U.S. Cl.

CPC ..... *H01F 27/303* (2013.01); *H01F 27/12* (2013.01); *H01F 27/402* (2013.01); *H01F 30/06* (2013.01)

(58) Field of Classification Search

USPC ..... 336/197, 55–60

See application file for complete search history.

(56) References Cited

U.S. PATENT DOCUMENTS

| | | | |
|---|---|---|---|
| 3,167,703 | A | 1/1965 | Schindler |
| 3,772,627 | A | 11/1973 | Wilk et al. |
| 3,978,442 | A | 8/1976 | Spicar |

(Continued)

FOREIGN PATENT DOCUMENTS

| | | | |
|---|---|---|---|
| DE | 1513977 | A1 | 7/1969 |
| DE | 2236212 | A1 | 2/1974 |

(Continued)

OTHER PUBLICATIONS

Ayers R E et al: "Dynamic Measurements During Short-Circuit Testing of Transformers Part I: Instrumentation and Testing", IEEE Transactions on Power Apparatus and Systems, IEEE Inc. New York, US, vol. 82, No. 4, Jul. 1, 1974 (Jul. 1, 1974), pp. 1045-1053, XP011161408, ISSN: 0018-9510.

*Primary Examiner* — Elvin G Enad
*Assistant Examiner* — Kazi S Hossain
(74) *Attorney, Agent, or Firm* — Laurence A. Greenberg; Werner H. Stemer; Ralph E. Locher

(57) ABSTRACT

An electrical device for connection to a high-voltage system includes a magnetizable core, at least one winding which encloses a section of the core, a tank which is filled with insulating fluid and in which the core and each winding are disposed, and at least one pressing element, which is surrounded by insulating fluid, for generating a winding pressure. The pressing element is supported on the core and the winding. In order to adjust the winding pressure from the outside in a simple and cost-effective manner, the pressing element is provided as a drivable pressing element and is connected to an actuating unit. The actuating unit is configured to set the winding pressure which is generated by the pressing element.

11 Claims, 2 Drawing Sheets

(56) References Cited

U.S. PATENT DOCUMENTS

| | | | | | |
|---|---|---|---|---|---|
| 4,009,461 | A * | 2/1977 | Usry | H01F 27/303 | 269/25 |
| 4,232,903 | A * | 11/1980 | Welling | E02F 3/8858 | 299/8 |
| 4,255,868 | A * | 3/1981 | Holzwarth | H01F 41/04 | 100/258 A |
| 6,080,964 | A * | 6/2000 | Gmeiner | H01F 27/14 | 219/400 |
| 8,522,626 | B2 | 9/2013 | Woodcock | | |
| 2010/0315190 | A1* | 12/2010 | Haj-Maharsi | H01F 27/40 | 336/192 |
| 2012/0247229 | A1* | 10/2012 | Woodcock | H01F 27/402 | 73/862.624 |
| 2014/0075744 | A1* | 3/2014 | Anger | H01F 27/002 | 29/606 |
| 2015/0256061 | A1* | 9/2015 | Koji | H01F 27/30 | 363/40 |

FOREIGN PATENT DOCUMENTS

| | | | |
|---|---|---|---|
| DE | 2260399 | A1 | 6/1974 |
| DE | 2547833 | A1 | 5/1976 |
| DE | 206015 | A1 | 1/1984 |
| DE | 19807903 | C2 | 11/2001 |
| EP | 0618596 | A1 | 10/1994 |
| GB | 1162956 | A | 9/1969 |
| WO | 2012138317 | A1 | 10/2012 |

* cited by examiner

ELECTRICAL DEVICE WITH DYNAMIC WINDING PRESSING

BACKGROUND OF THE INVENTION

Field of the Invention

The invention relates to an electrical device for connection to a high-voltage system, comprising a magnetizable core, at least one winding which encloses a section of the core, a tank which is filled with insulating fluid and in which the core and each winding are arranged, and at least one pressing element, which is surrounded by insulating fluid and is supported on the core and the winding, for generating a winding pressure.

An electrical device of this kind is known to a person skilled in the art from practice. For example, commercially available transformers have a magnetizable core which is formed from steel sheets which are situated against one another. The core has a plurality of limbs which extend in a longitudinal direction and which are connected to one another by means of an upper and a lower yoke. An upper and a lower pressing frame are provided in order to press the steel sheets together. The windings and the respective limb of the core are arranged concentrically and jointly in a tank which is filled with insulating fluid, wherein the insulating fluid is generally a mineral oil or else can consist of a synthetic or natural ester medium. The insulating fluid serves both to insulate the winding, which is at high-voltage potential during operation, from the tank, which is at ground potential, and also to cool the windings. In order to ensure the position or location of the windings during operation, the windings are pressed, or in other words braced, against the core limb. According to the prior art, pressing of the winding is performed before it is installed in the tank and generally with the aid of hydraulic cylinders which are temporarily used for generating pressure. Shortly before installation, the hydraulic cylinders or similar auxiliary means for temporary winding pressing are removed and replaced by wood packs, compression screws or other elements which can maintain the location of the winding statically in its state. Furthermore, pressing elements which have a mechanical spring element are known.

The electrical device described at the outset has the disadvantage that the static pressing elements do not have a spring travel or have only a short spring travel. However, over the service life of an electrical device or when short circuits occur frequently, it is possible for the winding heights to change (for example aging of the insulating paper, insulating structure, winding), so that the previously known pressing elements no longer provide the desired winding pressure. If it is necessary to check or even adjust the winding pressure, the winding with the core has to be removed from the tank or at least the transformer cover together with any accessories has to be removed. However, this is complicated and costly.

BRIEF SUMMARY OF THE INVENTION

The object of the invention is therefore to provide an electrical device of the kind cited at the outset with which the winding pressure can be adjusted from the outside in a simple and cost-effective manner.

The invention achieves this object in that the pressing element is configured as a drivable pressing element and is connected to an actuating unit, wherein the actuating unit is designed to set the winding pressure which is generated by the pressing element.

An electrical device in which the winding pressure can be easily set retrospectively is provided according to the invention. To this end, a drivable pressing element which is connected to an actuating unit is provided within the scope of the invention. The actuating unit is expediently arranged such that it is easily accessible from the outside. Therefore, the pressing element can be easily accessed with the aid of the actuating unit in order to set the desired winding pressure. Complicated removal of the entire winding is therefore rendered superfluous within the scope of the invention.

The pressing element is a force element and generates the pressing force required for the winding pressure, wherein the force which is provided by the pressing element corresponds to the control variable provided by the actuating unit at the output end. In principle, any pressing element which can generate a sufficiently large force between its two support points can be used within the scope of the invention.

Within the scope of the formulation selected here, the term "core" is intended to comprise both a magnetizable section of the core, which core is formed from steel sheets which bear against one another for example, and a pressing frame with the aid of which the steel sheets are pressed and held against one another.

According to a first variant of the invention, the pressing element is an electrically drivable pressing element which is connected to the actuating unit by means of an electrical connection line, wherein the actuating unit, at the output end, provides a predeterminable electrical voltage or a predeterminable electric current. An electrically drivable pressing element can be commercially acquired at low cost and can be easily integrated into the electrical device. The force which is provided by the electrical pressing element is furthermore largely independent of the temperature of the insulating fluid.

According to a related further development, the electrically drivable pressing element has a piezo element or an electric motor. A piezo element generates a contact-pressure force which is dependent on the applied voltage. The force which is provided by the piezo element can be increased by means of a suitable mechanism. In a departure from this, an electric motor is provided. Said electric motor may be, for example, a linear motor which is known as such to a person skilled in the art, and therefore detailed explanation can be omitted here. In order to prevent an output voltage and output current being permanently supplied to the drivable pressing element by the actuating unit, it is expedient to provide blocking means which allow the pressing element to be locked in a specific state in which a specific winding pressure is generated.

According to a further variant which differs from the above, the pressing element forms a hydraulic chamber which is filled with hydraulic fluid, wherein the winding pressure is determined by the pressure of the hydraulic fluid in the hydraulic chamber. In this case, the hydraulic chamber is coupled to compensation means for compensating for temperature-related fluctuations in the volume of the hydraulic fluid. In this variant of the invention, the pressing element is designed as a hydraulic pressing element. Since the pressing element is arranged within the tank of the electrical device, that is to say, for example, within a transformer or within the tank of a choke, the hydraulic fluid is subject to different temperatures which are dependent firstly on the outside temperature and secondly on the generated heat loss from the or each of the windings of the electrical device. However, the hydraulic fluid expands as the temperature increases, so that the winding pressure would increase very sharply without compensation means and could lead to damage to the windings or could damage the sealing system of the hydraulic chambers. The compensation means absorb the temperature-related fluctuations in the volume of the hydraulic fluid and keep the temperature-related fluctuations in winding pressure within an acceptable range.

According to a related expedient further development, the compensation means comprise a moving part which bounds the hydraulic chamber in a fluid-tight manner. Furthermore, the compensation means comprise spring means which are supported on said moving part. If the hydraulic fluid in the hydraulic chamber expands, this leads to movement of the moving part against the spring pressure which is provided by the spring means, as a result of which the spring is further tensioned. The internal pressure in the hydraulic chamber increases owing to this additional deformation of the spring, depending on the spring characteristic. However, the spring means expediently have a characteristic which ensures an only slight or negligible increase in the winding pressure.

In principle, the spring means can be designed in any desired manner within the scope of the invention. For example, the spring means can comprise mechanical spring elements. Examples include plate springs, mechanical helical springs or the like. However, in a departure from this, the spring means can also have pneumatic springs or else an elastically deformable elastomer which provides the desired spring characteristic.

The actuating unit is expediently a mechanical actuating unit and is designed to set the spring characteristic of the spring means. According to this advantageous further development, the actuating unit is connected to the spring means by means of a suitable mechanism. By virtue of mechanical operation of the actuating unit, for example by turning an actuating screw, a mechanical movement of the mechanism is transmitted to an actuating element of the spring means, said actuating element then changing the spring characteristic to the desired extent.

According to a preferred refinement of the invention, the compensation means have a compensation cylinder in which the moving part and the spring means are arranged, wherein the compensation cylinder is connected to a working cylinder by means of a hydraulic line, said working cylinder being supported on the core and the winding and generating the winding pressure. In this refinement, the working cylinder is a conventional hydraulic cylinder in which a working piston comprising a piston rod is arranged, said piston rod being supported either on the core or on the winding. The piston is held in the working cylinder such that it can move, so that, owing to the increase in the hydraulic pressure in the hydraulic chamber, the piston and the piston rod are pressed more strongly against the core or the winding and the winding pressure is increased. According to this variant according to the invention, the hydraulic chamber is not exclusively bounded by the working cylinder, but rather extends by means of the hydraulic line into a section, which is likewise filled with hydraulic fluid, of the compensation cylinder which is bounded in a fluid-tight manner by the moving part. The spring means are once again supported by way of one of their ends against said moving part, whereas that end of the spring means which is averted from the windings bears against an inner wall of the compensation cylinder. In other words, the hydraulic chamber is increased in size by the hydraulic line and the working cylinder. According to this further development of the invention, the working cylinder used can be a commercially available hydraulic cylinder which is connected to a further compensation cylinder by means of a likewise commercially available hydraulic line. The compensation cylinder can likewise be arranged within the tank of the electrical device or else can be fitted to the tank on the outside of said tank. A temperature-related expansion of the hydraulic fluid in the working cylinder is transmitted to the moving part in the compensation cylinder by means of the hydraulic line, so that spring means are once again compressed in order to compensate for the fluctuations in volume.

In a departure from the above, the working cylinder itself is supported on the core and the winding by means of the spring means. In other words, the moving part is a piston which is arranged in a working cylinder in a movable manner and which, together with the working cylinder, defines the hydraulic chamber, wherein the piston or the working cylinder is supported on the core or the winding by means of the spring means. According to this variant, the compensation means are at least partially integrated into the working cylinder. The spring means can be designed, for example, in the form of a spring-action section of the piston rod. In a departure from this, the working cylinder or the piston rod is supported on the spring means.

The hydraulic fluid and the insulating fluid are expediently identical. This prevents soiling of the insulating fluid in the event of the pressing element leaking.

The actuating unit advantageously has a hydraulic pump which is coupled to the hydraulic chamber. The hydraulic pump allows the winding pressure to be changed in a convenient manner. Therefore, the hydraulic pressure in the hydraulic chamber can be easily increased or reduced by accessing the hydraulic pump.

The actuating unit is expediently arranged outside the tank, so that the winding pressure can be adjusted in a convenient manner. However, according to a variant which differs from this, the actuating unit is arranged within the tank, but wherein a hand hole is provided, access to the actuating unit being possible by means of said hand hole. The actuating unit which is arranged in the tank is arranged in the interior of the tank such that it is protected against weather influences. Therefore, the hand hole has to be opened in order to change the winding pressure.

In order to still be able to provide a sufficient winding pressure if the pressing element fails, dimensionally stable spacers are provided between the core and the winding. These spacers are arranged, for example, in the immediate vicinity of the pressing elements. The spacers are designed, for example, as wood packs or compression screws.

According to a further expedient refinement of the invention, a sensor is provided for detecting the winding pressure, wherein the sensor is connected to a display element which displays the winding pressure. The sensor can be, for example, a pressure sensor for recording a hydraulic pressure. In a departure from this, the sensor can be configured as a force pickup which directly detects the force acting between the winding and the core. Force pickups, for example piezo elements or the like, are known to a person skilled in the art, and therefore a more precise description can be omitted at this point.

BRIEF DESCRIPTION OF THE SEVERAL VIEWS OF THE DRAWING

Further expedient refinements and advantages of the invention are the subject matter of the following description of exemplary embodiments of the invention with reference to the figures in the drawing, wherein identical reference symbols refer to identically acting components and in which.

DESCRIPTION OF THE INVENTION

Figure 1:
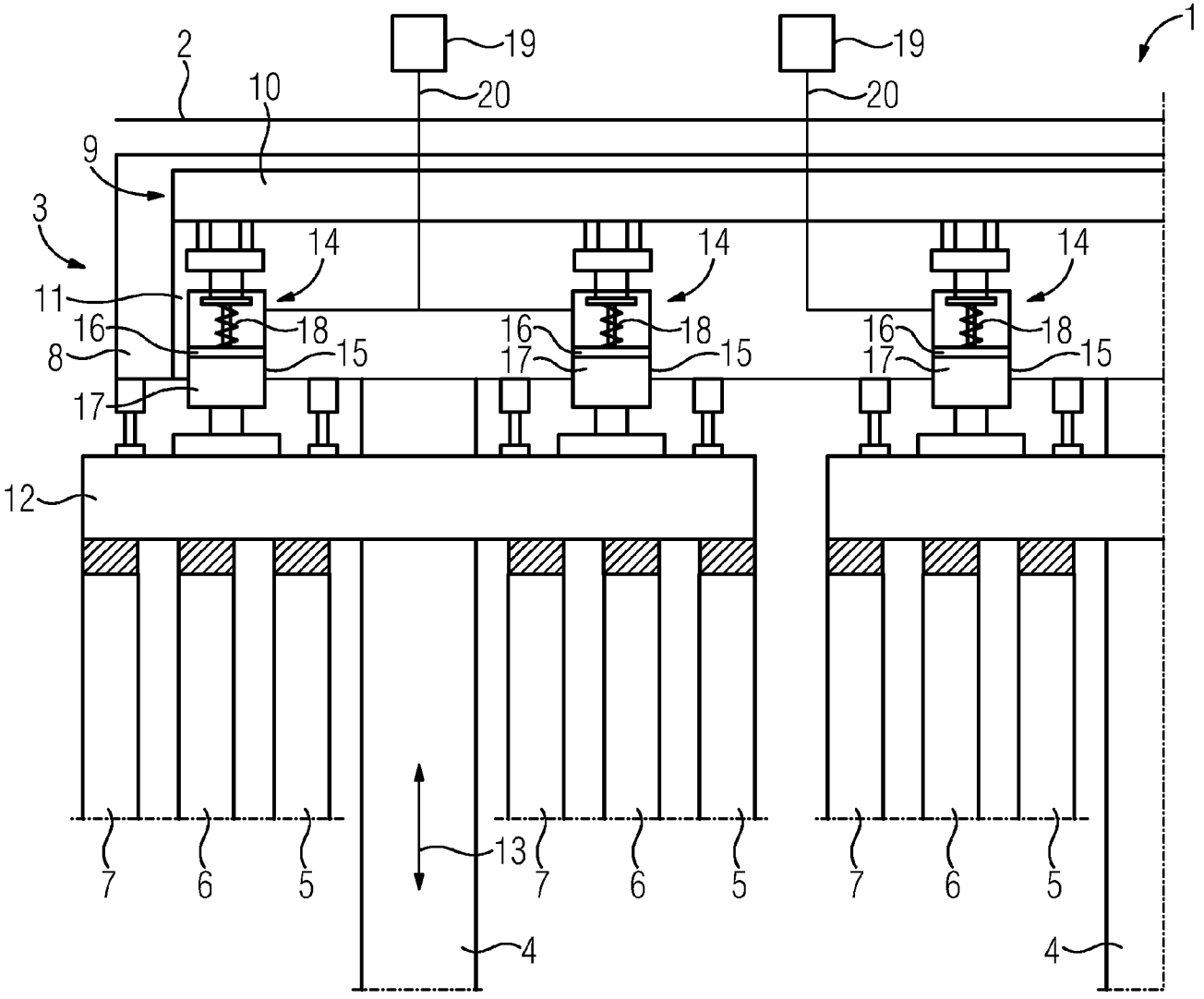
FIG. 1 shows a schematic side view of a first exemplary embodiment of the electrical device according to the invention.

FIG. 1 shows an exemplary embodiment of the electrical device 1 according to the invention which is designed as a transformer. The transformer 1 has a fluid-tight tank 2 in which a core 3 is arranged. The core 3 has a magnetizable section which is formed from steel sheets which bear against one another and forms limbs 4 which, in the exemplary embodiment shown, are each concentrically surrounded by three partial windings 5, 6 and 7. The core limbs 4 are connected to one another at their top end by a likewise magnetizable upper yoke 8, wherein the upper yoke 8 is compressed from both sides by a pressing frame 9. The non-magnetizable pressing frame 9 is designed in an L-shape as a constituent part of the core 3 in the exemplary embodiment shown and has a shoulder 10 which protrudes out of the plane of the drawing and which extends at a right angle to a contact-pressure limb 11 which extends parallel to the upper yoke 8. A winding ring 12 which can be displaced in the indicated longitudinal direction 13 and rests on the end sides of the windings 5, 6 and 7 is shown above the windings 5, 6, 7. Drivable pressing elements 14 which each have a working cylinder 15 in which a piston 16 is guided such that it can move in the longitudinal direction 13 are supported on the winding ring 12 at one end and the shoulder 10 at the other end. The working cylinder 15 and the piston 16 bound a hydraulic chamber 17 which is filled with a hydraulic fluid. The piston 16 bears against the inner wall of the working cylinder 15 in a fluid-tight manner with the aid of sealing means. Spring means 18 which are supported on the piston at one end and on the inner wall of the working cylinder 15 at the other end are provided on that side of the piston 16 which is averted from the hydraulic chamber 17.

Two actuating units 19 which are connected to the spring means by means of a mechanical connection 20 are shown outside the tank 2. The actuating unit and the mechanical connection allow adjustment of the spring characteristic of the spring means 18. For example, the spring can be pretensioned to a greater extent by means of the mechanism 20, as a result of which the spring characteristic changes and, at the same time, the contact pressure of the winding ring 12 on the winding end sides or, in other words, the winding pressure is increased.

When the insulating fluid within the tank 2 is heated, the hydraulic fluid in the hydraulic chamber 17 is also heated, wherein the hydraulic fluid expands. The piston 16 is pushed upward in the process. This leads to further compression of the spring means 18. In this case, the winding pressure increases, but to a considerably reduced extent in comparison to the refinement without springs. The increase in the winding pressure can be predetermined with the aid of the spring characteristic. In order to be able to maintain a minimum winding pressure if there is a defect in the hydraulic system, for example if there is a leak in the hydraulic chamber 17, dimensionally stable spacers 30 are arranged between the core, here the contact-pressure limb 11, and the winding ring 12. It goes without saying that the winding ring 12 is composed of a non-deformable material.

Figure 2:
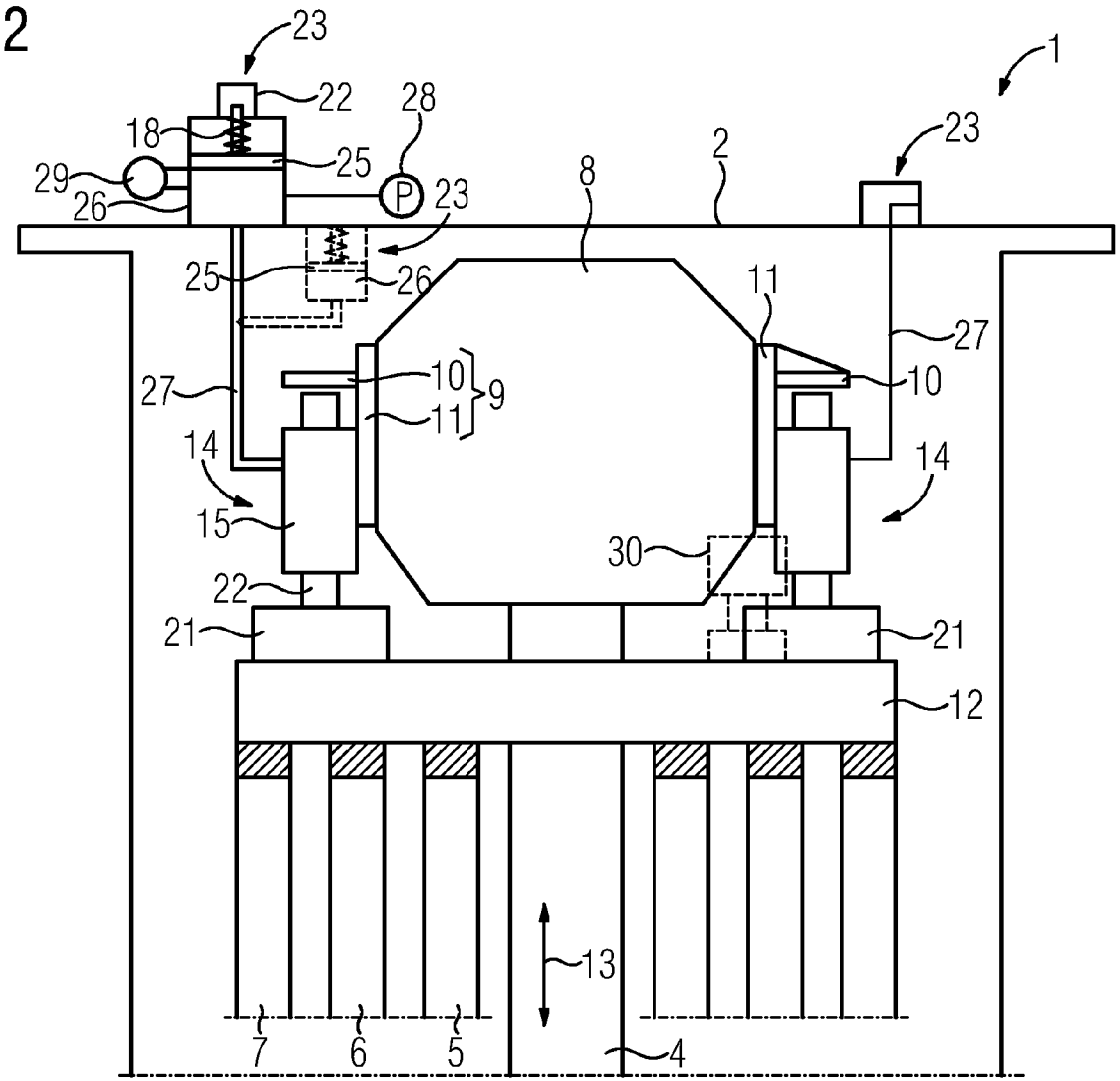
FIG. 2 shows a schematic lateral view of a further exemplary embodiment of the electrical device according to the invention.

FIG. 2 shows a schematic lateral view of a further exemplary embodiment of the transformer 1 according to the invention. The exemplary embodiment shown in FIG. 2 differs from the refinement shown in FIG. 1 schematically in terms of the configuration of the pressing elements 14. The pressing elements 14 are no longer directly supported on the winding ring 12. Instead, enclosures 21 which allow less expansive pressing elements to be used are provided. The pressing element 14 shown in FIG. 2 is a commercially available hydraulic cylinder which is called working cylinder 15 here. A portion of the hydraulic chamber 17 which is bounded there by a moving piston is formed in the working cylinder 15. The piston which is guided in a fluid-tight manner is equipped with a piston rod 22 which extends out of the working cylinder 15.

A compensation vessel 23 which has a moving part 24 which is arranged in a compensation cylinder 26 and is guided in said compensation cylinder in a fluid-tight and movable manner is shown outside the tank 2. A hydraulic line 27 extends between the compensation cylinder 26 and the working cylinder 15. In this exemplary embodiment, the hydraulic chamber is bounded by the moving part 25, the piston, not illustrated in the figure, of the working cylinder 15 and the hydraulic line 27. Spring means 18 which serve to compensate for temperature-related fluctuations in the volume of the hydraulic fluid 17 are supported on that side of the moving part 25 which is averted from the hydraulic chamber. The piston rod 22 which protrudes out of the compensation cylinder 26 is not supported against any components and is therefore freely movable in the longitudinal direction 13. Furthermore, the compensation means 23 comprise a hydraulic pump 28 and a pressure display 29 which is connected to a pressure pickup, not illustrated in the figure and arranged in the hydraulic chamber, and displays the pressure prevailing in the hydraulic chamber. The hydraulic pump 28 is an actuating unit within the meaning of the invention and allows the winding pressure to be set in the desired manner. If, for example, the winding pressure is to be increased, the hydraulic pump 28 is switched on, so that the hydraulic pressure both in the compensation cylinder 26 and also in the working cylinder 15 increases. In accordance with said pressure increase, an increased force is introduced into the end sides of the windings 5, 6 and 7 by means of the piston rod 22, the enclosures 21 and the winding ring 12. This increases the winding pressure.

A further variant of the apparatus according to the invention is illustrated in dashed lines in FIG. 2. In this refinement of the invention, the compensation element 23 is no longer arranged outside the tank 2, but rather within the fluid space of the tank 2. The compensation means 23 again comprise a compensation cylinder 26 with a moving part 25 which is guided in a movable manner in the compensation cylinder and bounds a hydraulic chamber in said compensation cylinder in a fluid-tight manner, said hydraulic chamber being formed by a portion of the compensation cylinder 26, the connecting line 27 and a portion of the working cylinder 15. A separate actuating unit, which serves to change the spring characteristic of the spring means 18, is not illustrated in the figure. Here, the compensation means 23 are arranged in the upper region of the tank 2, which has a hand hole, not illustrated in the figure, which can be opened from the outside, so that access to the compensation means 23 is possible. In this example, the actuating unit is integrated in the compensation cylinder 26 and can be adjusted from the outside through the hand hole.

The invention claimed is:

1. An electrical device for connection to a high-voltage system, the electrical device comprising:

a tank filled with insulating fluid;

a magnetizable core disposed in said tank;

at least one winding enclosing a section of said magnetizable core, said at least one winding being disposed in said tank;

at least one drivable pressing element for generating a winding pressure, said at least one drivable pressing element being surrounded by insulating fluid and being supported on said magnetizable core and said at least one winding;

said drivable pressing element forming a hydraulic chamber being filled with hydraulic fluid;

said winding pressure being determined by a pressure of the hydraulic fluid in said hydraulic chamber;

a compensation device coupled to said hydraulic chamber to compensate for temperature-related fluctuations in a volume of the hydraulic fluid; and an actuating unit being connected to said drivable pressing element and being configured to set said winding pressure generated by said drivable pressing element.

2. The electrical device according to claim 1, wherein:

said drivable pressing element is an electrically drivable pressing element;

an electrical connection line connects said electrically drivable pressing element to said actuating unit; and said actuating unit has an output end providing a predeterminable electrical voltage or a predeterminable electric current.

3. The electrical device according to claim 1, wherein said compensation device includes a moving part fluid-tightly delimiting said hydraulic chamber and a spring device supporting said moving part.

4. The electrical device according to claim 3, wherein said actuating unit is a mechanical actuating unit and is configured to set a spring pressure of said spring device.

5. The electrical device according to claim 3, wherein:

said compensation device has a compensation cylinder in which said moving part and said spring device are disposed;

a working cylinder is supported on said magnetizable core and said at least one winding and generates said winding pressure; and a hydraulic line connects said compensation cylinder to said working cylinder.

6. The electrical device according to claim 3, which further comprises:

a working cylinder;

said moving part being a piston movable in said working cylinder;

said piston and said working cylinder together defining said hydraulic chamber; and said spring device supporting said piston on said magnetizable core or said at least one winding.

7. The electrical device according to claim 1, wherein the hydraulic fluid and the insulating fluid are identical.

8. The electrical device according to claim 1, wherein said actuating unit has a hydraulic pump coupled to said hydraulic chamber.

9. The electrical device according to claim 1, wherein said actuating unit is disposed outside said tank.

10. The electrical device according to claim 1, which further comprises at least one dimensionally stable spacer disposed between said magnetizable core and said at least one winding for providing a minimum winding pressure.

11. The electrical device according to claim 1, which further comprises a sensor for detecting said winding pressure, and a display element connected to said sensor for displaying said winding pressure.

* * * * *